US005307725A

United States Patent [19]

Desmond et al.

[11] Patent Number: 5,307,725

[45] Date of Patent: May 3, 1994

[54] LAW ENFORCEMENT HIGH RISK VEHICLE WINDSHIELD PROTECTIVE DEVICE

[76] Inventors: Richard M. Desmond, 17 Dorchester Rd., Lake Ronkonkoma, N.Y. 11779; William B. Kirchhoff, 112-47th St., Lindenhurst, N.Y. 11757

[21] Appl. No.: 65,484

[22] Filed: May 24, 1993

[51] Int. Cl.[5] ..... F41H 5/26

[52] U.S. Cl. ..... 89/36.14; 89/40.03; 296/96; 296/152

[58] Field of Search ..... 89/36.07, 36.08, 36.14, 89/40.03; 109/49.5; 296/95.1, 96, 96.14, 96.2, 96.21, 152

[56] References Cited

U.S. PATENT DOCUMENTS 3,855,898 12/1974 McDonald ..... 89/36.14

3,866,242 2/1975 Slagel ..... 109/49.5

4,643,477 2/1987 Kovatch ..... 89/36.14

*Primary Examiner*—Stephen C. Bentley

*Attorney, Agent, or Firm*—Richard L. Miller

[57] ABSTRACT

A high risk vehicle windshield protective device is provided for a windshield of an automobile and consists of a bullet resistant panel pivotally mounted to the underside of the roof of the automobile adjacent the windshield. A bullet proof glass panel slides within a pair of tracks on the forward side edges of the bullet resistant panel, so that it can be pulled down and extended behind the windshield to protect an occupant most likely the driver from being shot through the windshield during dangerous situation and alternatively stored away when not in use.

5 Claims, 1 Drawing Sheet

LAW ENFORCEMENT HIGH RISK VEHICLE WINDSHIELD PROTECTIVE DEVICE

BACKGROUND OF THE INVENTION

The instant invention relates generally to protective transparent shields and more specifically it relates to a law enforcement high risk vehicle windshield protective device.

Numerous protective transparent shields have been provided in the prior art that are adapted to be utilized on windshields of motor vehicles, so as to withstand gun fire at close range. For example, U.S. Pat. No. 3,855,898 to McDonald; U.S. Pat. No. 3,866,242 to Slagel and U.S. Pat. No. 4,643,477 to Kovatch all are illustrative of such prior art. While these units may be suitable for the particular purpose to which they address, they would not be as suitable for the purpose of the present invention as hereafter described.

SUMMARY OF THE INVENTION

A primary object of the present invention is to provide a law enforcement high risk vehicle windshield protective device that will overcome the shortcomings of the prior art devices.

Another object is to provide a law enforcement high risk vehicle windshield protective device that is pivotally mounted to the underside of the roof, so that it can be pulled down into position behind the windshield to protect an occupant most likely the driver from being shot through the windshield.

An additional object is to provide a law enforcement high risk vehicle windshield protective device that can be retained against the underside of the roof by a magnetic latch in a folded stored position when not in use.

A further object is to provide a law enforcement high risk vehicle windshield protective device that is simple and easy to use.

A still further object is to provide a law enforcement high risk vehicle windshield protective device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
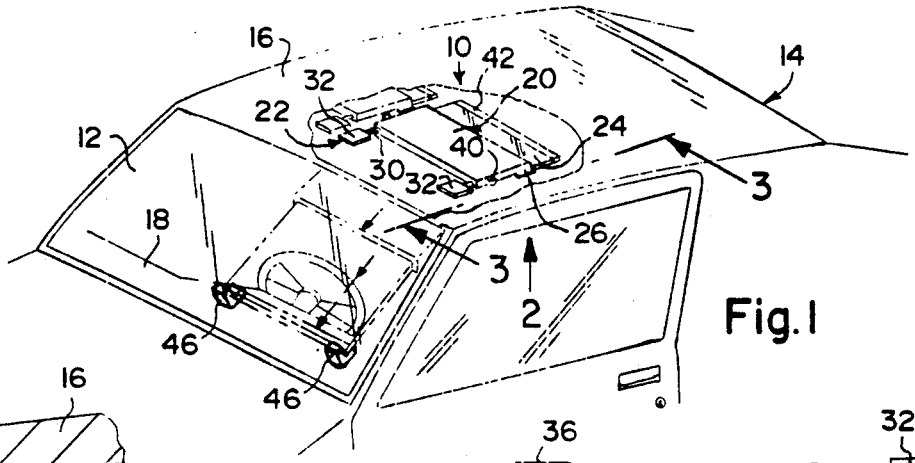
FIG. 1 is a diagrammatic perspective view of an automobile with the instant invention installed therein.
Figure 7:
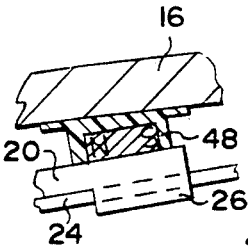
FIG. 7 is an enlarged diagrammatic view with parts broken away of the area illustrated in the dotted circle of arrow 7 in FIG. 3 showing a magnetic latch securing the instant invention in a folded position to the roof of the automobile.
Figure 3:
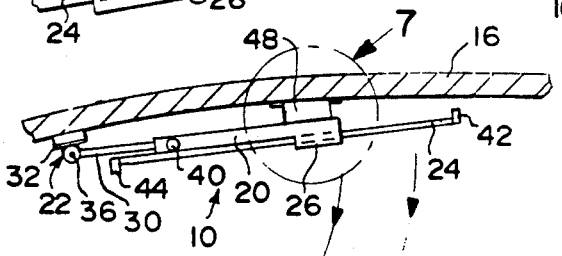
FIG. 3 is a cross sectional view taken on line 3—3 of FIG. 1.
Figure 2:
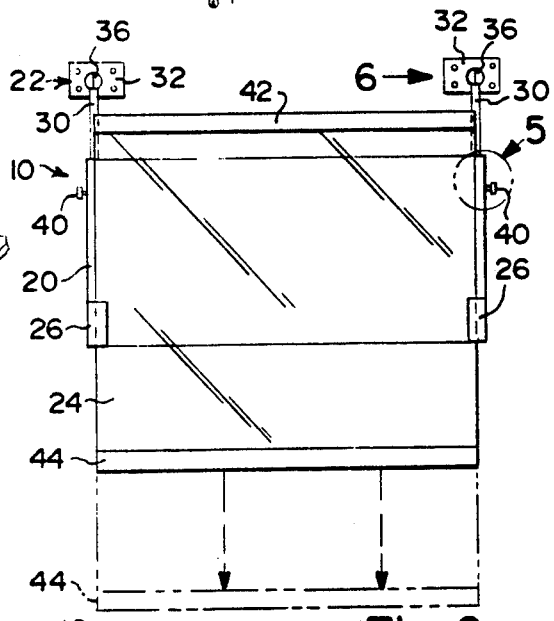
FIG. 2 is a diagrammatic bottom view of the instant invention taken in the direction of arrow 2 in FIG. 1.
Figure 4:
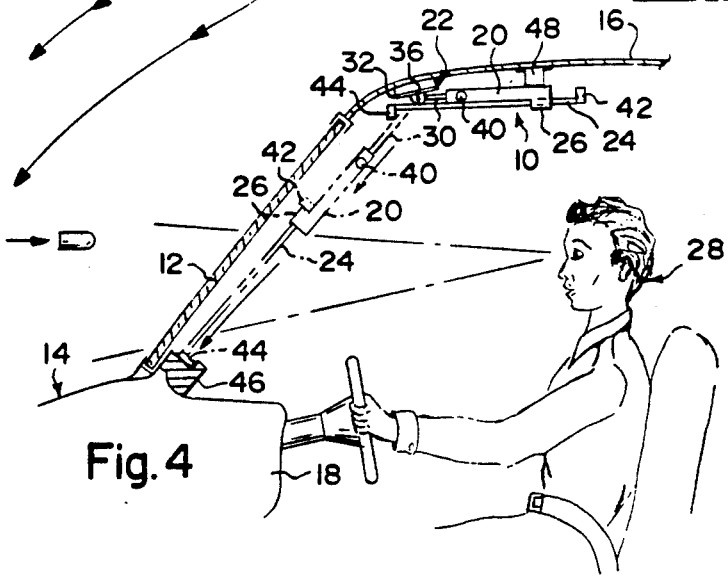
FIG. 4 is a diagrammatic cross sectional view of a portion of the automobile illustrating the instant invention installed therein.
Figure 6:
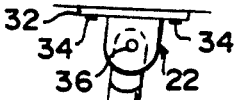
FIG. 6 is an enlarged diagrammatic view with parts broken away taken in the direction of arrow 6 in FIG. 2.
Figure 5:
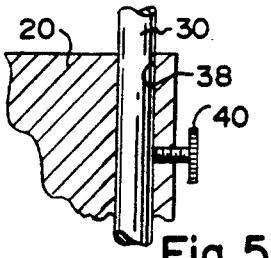
FIG. 5 is an enlarged diagrammatic view partially in section of the area shown in the dotted circle of arrow 5 of FIG. 2.

Turning now descriptively to the drawings, in which similar reference characters denote similar elements throughout the several views, the Figures illustrate a high risk vehicle windshield protective device 10 for a windshield 12 of an automobile 14 having a roof 16 and a dashboard 18. The device 10 consists of a bullet resistant panel 20 typically but not necessarily fabricated from metal. A structure 22 is for pivotally mounting the bullet resistant panel 20 to the underside of the roof 16 adjacent the windshield 12 of the automobile 14. A bullet proof glass or glass like material panel 24 is also provided. A pair of tracks 26 are each affixed to an opposite forward side edge of the bullet resistant panel 20, to allow the glass panel 24 to slide thereupon. In a first instance, the high risk vehicle windshield protective device 10 can be stored in a folded position against the underside of the roof 16 when not in use. In a second instance, the high risk vehicle windshield protective device 10 can be pulled down with the glass panel 24 extended from the bullet resistant panel 20 behind the windshield 12 in a useable position, to protect an occupant or the driver 28 from being shot through the windshield 12.

The pivotable mounting structure 22 includes a pair of rods 30, each extending from an opposite rearward corner of the bullet resistant panel 20. A pair of mounting brackets 32 are provided with a plurality of bolts 34, for affixing each mounting bracket 32 to the underside of the roof 16. A friction hinge 36 is located between each mounting bracket 32 and a distal end of each rod 30.

Each rearward corner of the bullet resistant panel 20 has a bore 38 extending therein, so that each rod 30 can slide within the bore 38. A set screw 40 is threaded into each opposite rearward side edge of the bullet resistant panel 20 to transversely engage with each rod 30 to maintain the rod in a stationary condition with respect to the bullet resistant panel 20.

A pair of stop bars 42 and 44 are mounted to the upper and lower edges of the glass panel 24 to prevent the glass panel 24 from sliding completely out of the tracks 26. A pair of immobilizing blocks 46 are spaced apart and mounted to the top of the dashboard 18 to engage with and retain the lower stop bar 44, when the high risk vehicle windshield protective device 10 is extended in the useable position.

The tracks 26 are is fabricated out of magnetic metal material. Magnetic latches 48 are secured to the underside of the roof 16 above the the tracks 26, when in the stored folded position, so that the high risk vehicle windshield protective device 10 will be retained by the magnetic latch 48 to help prevent the high risk vehicle windshield protective device 10 from accidentally dropping down from the roof 16.

If the driver or passenger occupant 28 sees danger through the windshield 12, the high risk vehicle windshield protective device 10 can be pulled down from its folded stored position and the glass panel 24 extended until the lower stop bar 44 contacts the immobilizing blocks 46. This will allow an occupant 28 to still see through a portion of the windshield 12 and be protected by the glass panel 24. When the danger is passed the glass panel 24 can be extended upwardly and the high risk vehicle windshield protective device 10 pushed back to its folded stored position with the magnetic latch 48 retaining the metal tracks 26 thereto.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A law enforcement high risk vehicle windshield protective device, said vehicle having a roof and a dashboard, said device comprising:

a) a bullet resistant panel;

b) means for pivotally mounting said bullet resistant panel to the underside of said roof adjacent said windshield of said automobile;

c) a bullet proof glass panel; and d) a pair of tracks, each affixed to an opposite forward side edge of said bullet resistant panel to allow said glass panel to slide thereupon, so that in a first instance said high risk vehicle windshield protective device can be stored in a folded position against the underside of said roof when not in use and in a second instance said high risk vehicle windshield protective device can be pulled down with said glass panel extended from said bullet resistant panel behind said windshield in a useable position to protect an occupant of the automobile from being shot through said windshield.

2. A high risk vehicle windshield protective device as recited in claim 1, wherein said pivotable mounting means includes:

a) a pair of rods, each extending from an opposite rearward corner of said bullet resistant panel;

b) a pair of mounting brackets;

c) a plurality of bolts for affixing each said mounting bracket to the underside of said roof; and d) a pair of friction hinges, each located between each mounted bracket and a distal end of each said rod.

3. A high risk vehicle windshield protective device as recited in claim 2, further including:

a) each said rearward corner of said bullet resistant panel having a bore extending therein, so that each said rod can slide within said bore; and b) a pair of set screws, each threaded into an opposite rearward side edge of said bullet resistant panel to transversely engage with each said rod to maintain said rod in a stationary condition with respect to said bullet resistant panel.

4. A high risk vehicle windshield protective device as recited in claim 3, further including:

a) a pair of stop bars mounted to the upper and lower edges of said glass panel to prevent said glass panel from sliding completely out of said tracks; and b) a pair of unmobilizing blocks spaced apart and mounted to the top of said dashboard to engage with and retain said lower stop bar when said high risk vehicle windshield protective device is extended in the useable position.

5. A high risk vehicle windshield protective device as recited in claim 4, further including:

a) said tracks each fabricated out of magnetic metal material; and b) a magnetic latch secured to the underside of said roof above said each said track when in the stored folded position, so that said high risk vehicle windshield protective device will be retained by said magnetic latch to help prevent said high risk vehicle windshield protective device from accidentally dropping down from said roof.

* * * * *